US009856181B1

(12) United States Patent
Sabatini et al.

(10) Patent No.: US 9,856,181 B1
(45) Date of Patent: Jan. 2, 2018

(54) PERCHLORATE-FREE RED PYROTECHNIC ILLUMINANT COMPOSITIONS

(71) Applicants: Jesse J. Sabatini, Bel Air, MD (US); Jared D. Moretti, Randolph, NJ (US)

(72) Inventors: Jesse J. Sabatini, Bel Air, MD (US); Jared D. Moretti, Randolph, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 321 days.

(21) Appl. No.: 14/662,383

(22) Filed: Mar. 19, 2015

(51) Int. Cl.

| | |
|---|---|
| ***C06B 31/00*** | (2006.01) |
| ***C06B 31/02*** | (2006.01) |
| ***C06B 33/00*** | (2006.01) |
| ***C06B 33/04*** | (2006.01) |
| ***C06B 33/14*** | (2006.01) |

(52) U.S. Cl.
CPC ..... *C06B 33/14* (2013.01)

(58) Field of Classification Search
CPC ..... C06B 31/00; C06B 31/02; C06B 33/00; C06B 33/04
See application file for complete search history.

(56) References Cited

U.S. PATENT DOCUMENTS 8,608,879 B1 * 12/2013 Sabatini ..... C06B 33/04 149/108.2
2015/0376079 A1 * 12/2015 Pliskin ..... C06B 33/00 102/335

OTHER PUBLICATIONS

Versamid 140, Technical Data Sheet by Gabriel, available at https://www.gabrielchem.com/wp-content/uploads/VERSAMID-140-TDS-GPI.pdf (last accessed Jun. 12, 2017).
EPON Resin 813, Technical Data Sheet by Hexion, available at http://www.hexion.com/Products/TechnicalDataSheet.aspx?id=2759 (last accessed Jun. 12, 2017).

* cited by examiner

*Primary Examiner* — Aileen B Felton
(74) *Attorney, Agent, or Firm* — Lisa H. Wang

(57) ABSTRACT

The present invention is a red-light-emitting composition based upon a potassium periodate oxidizer formulation, which is useful as the illuminant in the US military's M662 40 mm red star parachute projectile, and which composition is composed of readily commercially available ingredients—ingredients that are environmentally friendly. Further, the subject inventive potassium periodate formulation provides significant enhanced illumination and safety versus the current military M662 illuminant which is based upon potassium perchlorate oxidizer formulation.

4 Claims, No Drawings

PERCHLORATE-FREE RED PYROTECHNIC ILLUMINANT COMPOSITIONS

FEDERAL RESEARCH STATEMENT

The invention described herein may be manufactured, used, and/or licensed by the U.S. Government for U.S. Government purposes, without the payment of any royalty therefore.

FIELD OF THE INVENTION

The present invention relates to red illuminant compositions, and particularly to such compositions formulated useful in the M662 a red-light-emitting 40 mm parachute illuminant, that does not contain any potassium perchlorate oxidizer, so as to be significantly less toxic and more environmentally friendly than the prior art.

BACKGROUND OF THE INVENTION

The U.S. military uses a family of 40 mm ammunition which includes high explosive grenades and various star and parachute illumination pyrotechnics—in white, green and red for illumination and signal purposes. More specifically, such illumination and signals are useful both day and night, to communicate a prearranged message, provide a beacon for rescuers, or to disclose, or illuminate the positions of military units or personnel. Such rescue or attention—getting applications are common in non-military situations, as well as, in military combat and training scenarios—the illuminant being shot at about 250 fps to a burst height of about 600 feet. Generally, these pyrotechnic illuminants contain significant amounts of potassium perchlorate ($KClO_4$), a strong oxidizing material—which exothermically transfers oxygen to combustible materials, to provide pyrotechnics with a significant rate of combustion in air. However, $KClO_4$ contaminates groundwater and impacts public drinking water. In particular, $KClO_4$ interferes with hormonal regulation of the thyroid gland, and is known to be teratogenic. Accordingly, the U.S. Environmental Protection Agency has established a permissible $KClO_4$ level at 15 parts per billion, and various states have mandated even lower levels, e.g. California has mandated no more than 6 parts per billion and Massachusetts has mandated only 2 parts per billion. In response, the U.S. Department of Defense is spending billions of dollars annually on perchlorate remediation efforts.

Colors in illuminating pyrotechnics are obtained by the addition of specific ingredients, which offer the desired flame color. For example, green is obtained with the addition of barium nitrate, which acts as both a color agent and an oxidizer. Similarly, strontium nitrate provides intense red and also acts as an oxidizer. The corresponding light emitting species (in the gas phase, during flaming) are the monohydroxides, SrOH and BaOH, and the monochlorides, SrCl and BaCl, for red and green. Therefore, as stated above, commonly in red or green pyrotechnics, potassium perchlorate ($KClO_4$) is used—as, a chloride ion and hydroxide ion donor, which also is a strong oxidizer.

One 40 mm parachute deployed illuminant of particular interest is the U.S. Army red signal/illuminating device; the M662 parachute. The $KClO_4$-containing in-service M662 red signal/illuminating pyrotechnic formulation (see Table 1, below) has a burn time of about 40 seconds, a minimum luminous intensity of about 19,000 candela, a dominant wavelength of 607 nanometers and a spectral purity of about 86.8%. This red military illuminant device is housed within a 40 mm hollow aluminum body, and as stated above, is fired to a height of about 600 feet, and floats back to earth suspended from a parachute—providing the desired red illumination or signal as it floats downward.

TABLE 1

Current M662 red signal/illuminating pyrotechnic material.

| Ingredient | Weight Percentage |
|---|---|
| Strontium Nitrate ($Sr(NO_3)_2$) | 41.1 |
| Magnesium 30/50 | 30.8 |
| Polyvinyl Chloride (PVC) | 12.8 |
| Potassium Perchlorate ($KClO_4$) | 10.3 |
| Laminac 4116/Lupersol Binder System | 5.0 |

As stated above, $KClO_4$ acts as an oxidizer, and is so used in the current M662 parachute illuminant; where, with a second oxidizer, strontium nitrate ($Sr(NO_3)_2$), the $KClO_4$ reacts with magnesium 30/50, an inorganic metallic fuel, to produce magnesium oxide (MgO). MgO is a gray body emitter, and is responsible for producing the necessary illumination intensity desired for the parachute illuminant (intensity measured in candela). Further, the reaction of the strontium atom with the chloride donor from another ingredient, polyvinyl chloride (PVC), will produce strontium (l) chloride (SrCl). SrCl is responsible for imparting the intense red color within the pyrotechnic material, though the strontium reacting with the oxidizer to produce strontium monohydroxide (SrOH) also contributes to the red emission. An organic-based/binder, usually Laminac 4116/Lupersol, mitigates the sensitivity and prevents separation of the oxidizer, fuel and chloride donor. And, finally, the resulting pyrotechnic material exhibits a good insensitivity to electrostatic discharge and a fair insensitivity to impact—but, only a moderate insensitivity to friction initiation.

Disclosed by Sabatini et al, Propellants, Explosives, Pyrotechnics, "Applications of High-Nitrogen Energetics in Pyrotechnics: Development of Perchlorate-Free Red Star M126A1 Hand-Held Signal Formulations with Superior Luminous Intensities and Burn Times," August 2011, Vol. 36, Issue 4, pp. 373-378 (Wiley-VCH Verlag GmbH & Co., KGaA, Weinheim), available online at: http://onlinelibrary.wiley.com/doi/10.1002/prep.201000061/pdf, is an alternative to $KClO_4$ based illuminant formulations for use in hand held signal (HHS)—which is similar to the subject 40 mm parachute illuminant—but, fired from a hand held tube. This alternative to $KClO_4$ based formulation involves the use of an organomemetallic salt, with a strontium core and two nitro groups, i.e. strontium bis-(1-methyl-5-nitriminotetrazolate) monohydrate—a high energy, high nitrogen fuel. While a synthesis of strontium bis-(1-methyl-5-nitriminotetrazolate) monohydrate is disclosed in an article by Thomas M. Klapötke et al., Propellants, Explosives, Pyrotechnics, "Coloring Properties of Various High-Nitrogen Compounds in Pyrotechnic Compositions," June 2010, Vol. 35, Issue 3, pp 213-219 (Wiley-VCH Verlag GmbH & Co., KGaA, Weinheim), use of such a synthesis is not amenable to mass, economic production and strontium bis-(1-methyl-5-nitriminotetrazolate) monohydrate is not commercially available.

More recently, another alternative red pyrotechnic illuminant was proposed by the inventors of the subject invention—again replacing the $KClO_4$ based illuminant—with 5-aminotetrazole (5-AT) as the primary oxidizer and using the same secondary strontium nitrate ($Sr(NO_3)_2$) oxidizer and the same magnesium 30/50 inorganic fuel and grey body emitter. However, this 5-AT alternative also suffered from the same lack of commercial availability as does the previously discussed strontium bis-(1-methyl-5-nitriminotetrazolate) monohydrate alternative.

Clearly, there is a need in the art for a commercially available, economical, environmentally friendly, and non-toxic alternative to $KClO_4$ in red pyrotechnic illuminant compositions, especially for use in 40 mm parachute devices and where the material provides a significant increase in insensitivity to friction initiation—i.e. increase in safety.

SUMMARY OF INVENTION

The present invention avoids the problems of the prior art as detailed above by substituting an environmentally friendly, economical, commercially available, alternative potassium periodate ($KIO_4$) oxidizer based red pyrotechnic material for the current, toxic and friction sensitive $KClO_4$ oxidizer based red pyrotechnic material. Further, as $KIO_4$ is widely commercially available, there is no issue with the inventive formulations, such as with strontium bis-(1-methyl-5-nitriminotetrazolate) monohydrate and 5-AT based formulations—where there is a lack of commercial availability. And, further still, the present invention also substitutes a widely available Epon 813/Versamid 140 binder for the current M662 Laminac 4116/Lupersol binder system—which contains suspected carcinogenic styrene monomer and the suspected endocrine disrupter dimethyl phthalate.

More specifically, the present inventive formulation contains roughly comparable ingredients, and quantities thereof, as used in the current M662 40 mm red pyrotechnic parachute illuminant formulation (see Table 1, above); except, substituting a quantity of $KIO_4$ for the current $KClO_4$, and with the addition of a moderate quantity of inorganic magnesium fuel, i.e. from 30.8 to 35.8 percent—thereby surprisingly resulting in almost 13,000 additional candela or luminous intensity—a 67.5% increase in luminosity—with only a slight reduction in burn time from the current 40.4 to 39.7 seconds. Further, by increasing the binder from 5 to 7 weight percent, and reducing the strontium nitrate weight percentage equally—an increase in burn time of 1.8 seconds was achieved and the luminous intensity still increased over 8,200 candela. And, further still, not only was the red dominant wavelength roughly equivalent between the inventive formulation and the current M662 pyrotechnic illuminant composition—but, the spectral purity was the same. And, critically, the friction sensitivity of an embodiment of the inventive formulation was proven to be greater than 360 Newtons (N) versus only 80 N for the current M662 potassium perchlorate based red pyrotechnic material—an increase of 450%.

The particular red flare composition of the present invention, as described above, is set-out in the formulations shown in table 2, below.

TABLE 2

Red pyrotechnic illuminant formulations of the present invention.

| Ingredient | Weight Percentage(s)[1] |
|---|---|
| Strontium Nitrate ($Sr(NO_3)_2$), a first oxidizer | 41.1-39.1 |
| Magnesium 30/50, an inorganic fuel and gray body emitter | 30.8-35.8 |
| Polyvinyl Chloride (PVC), a chlorine donor | 12.8 |

TABLE 2-continued

Red pyrotechnic illuminant formulations of the present invention.

| Ingredient | Weight Percentage(s)[1] |
|---|---|
| Potassium Periodate ($KIO_4$), a second oxidizer | 10.3-5.3 |
| Epon 813/Versamid 140 Binder System[2] | 5.0-7.0 |

Note 1:
the subject inventive red pyrotechnic illuminant formulation is comprised of weight percentages which are about the values presented in this table and comprise all of the values within the ranges given.
Note 2:
the Epon 813/Versamid 140 Binder System is composed of 80 weight percent Epon 813 and 20 weight percent Versamid 140 - wherein the Epon 813 is a low viscosity bisphenol-A based epoxy resin diluted with cresyl glycidyl ether and the Versamid 140 is a cross-linked polyamine.

In the present invention, involving the substitution of potassium periodate for potassium perchlorate, the main advantage is thought to be due to the large atomic radius of the periodate ion ($IO_4$)—which is not expected to compete with I— in the same fashion as the perchlorate ion ($ClO_4$—), thus mitigating the environmental and human health hazards. Further, a potassium periodate formulation will be more thermodynamically stable and less water soluble than a potassium perchlorate formulation—advantages for military pyrotechnic illuminants in the field. And similar to potassium perchlorate, as an oxidizer potassium periodate readily liberates oxygen in an exothermic fashion, thus contributing energy to the pyrotechnic illuminant system. However, unlike potassium perchlorate, which liberates oxygen in a single step process around 550 degrees C., the exothermic decomposition of potassium periodate is a two-step process. In the first step, a single oxygen molecule is lost around 297 degrees C. And, at temperatures beginning at 507 degrees C., the remaining $KIO_3$ moiety further decomposes to produce KI and additional oxygen. Therefore, the overall oxidation effect with the decomposition of the potassium periodate is an enhancement over that of the prior potassium perchlorate—as oxygen begins to be liberated at a significantly lower temperature of 297 vs. 550 degrees C.

In formulating the present inventive pyrotechnic illuminant compositions, useful as a red M662 40 mm parachute illuminant, the ingredients are mixed under ambient conditions. Preferably, the binder is first mixed with the magnesium; the potassium periodate is then mixed in; the PVC and strontium nitrate are then mixed in (which two ingredients can be premixed and added together)—all mixing is done until a uniform mixture is obtained (wherein about 10 to about 20 minutes mixing can be required to obtain a uniform mixture). With the use of the preferred Epon 813/Versamid 140 binder system, the final mixture should be allowed to sit, unconsolidated, for about 1 to about 3 hours—whereupon it can be pressed into the desired illuminant form (the prior Laminac 4116/Lupersol binder system required curing for a 10 to 12 hour period in an oven, at about 140 degrees F., prior to pressing).

The nature of the subject invention will be more clearly understood by reference to the following detailed description and the appended claims.

DETAILED DESCRIPTION OF THE INVENTION

The present invention comprises environmentally safe and significantly brighter red pyrotechnic illuminant compositions, useful in U.S. military M662 red star parachute 40 mm projectiles, in which a potassium periodate ($KIO_4$)

oxidizer is substituted for the conventional strong potassium perchlorate ($KClO_4$) oxidizer. In fact, a potassium periodate based pyrotechnic illuminant of the present inventive formulation (Table 3, Formulation G—below) burned 1.39 times brighter, with 1.52 times the luminous efficiency (in [(cd-s)$g^{-1}$]), and had a longer burn time than the current M662 potassium perchlorate based red pyrotechnic illuminant formulation. Further, the luminosity (in cd) of this particular inventive formulation exceeded the luminosity of the prior art alternative strontium bis-(1-methyl-5-nitriminotetrazolate) monohydrate and 5-AT based formulations.

Alternative embodiments of the present potassium periodate formulations shown in Table 2 above have been selected and detailed in Table 3 below. The performance data relevant to M662 40 mm red star illuminant parachute projectiles for the selected embodiments shown in Table 3 are detailed in Table 4, also shown below. For reference/control purposes, also shown in Table 4 are the same performance characteristics data for the current M662, red star parachute potassium perchlorate based pyrotechnic illuminant formulation.

TABLE 3

Alternative embodiments of the present invention - Formulations G-J.

| Ingredient | Wt. % |
|---|---|
| Formulation G | |
| $Sr(NO_3)_2$ | 41.1 |
| Mg 30/50 | 30.8 |
| PVC | 12.8 |
| $KIO_4$ | 10.3 |
| Epon 813/Versamid 140 Binder | 5.0 |
| Formulation H | |
| $Sr(NO_3)_2$ | 41.1 |
| Mg 30/50 | 35.8 |
| PVC | 12.8 |
| $KIO_4$ | 5.3 |
| Epon 813/Versamid 140 Binder | 5.0 |
| Formulation I | |
| $Sr(NO_3)_2$ | 39.1 |
| Mg 30/50 | 30.8 |
| PVC | 12.8 |
| $KIO_4$ | 10.3 |
| Epon 813/Versamid 140 Binder | 7.0 |
| Formulation J | |
| $Sr(NO_3)_2$ | 39.1 |
| Mg 30/50 | 35.8 |
| PVC | 12.8 |
| $KIO_4$ | 5.3 |
| Epon 813/Versamid 140 Binder | 7.0 |

TABLE 4

Performance data for alternative embodiments G-J vs. current M662 illuminant.

| Formulation | BT[a] (s) | LI[b] (cd) | LE[c] ([cd s]$g^{-1}$) | DW[d] (nm) | SP[e] (%) |
|---|---|---|---|---|---|
| Current M662 | 40.4 | 19,098 | 9,572 | 607.2 | 86.8 |
| G | 43.8 | 26,471 | 14,540 | 607.8 | 87.0 |
| H | 39.7 | 31,995 | 15,908 | 607.2 | 86.8 |

TABLE 4-continued

Performance data for alternative embodiments G-J vs. current M662 illuminant.

| Formulation | BT[a] (s) | LI[b] (cd) | LE[c] ([cd s]$g^{-1}$) | DW[d] (nm) | SP[e] (%) |
|---|---|---|---|---|---|
| I | 44.1 | 23,478 | 12,964 | 608.4 | 86.8 |
| J | 42.2 | 27,307 | 14,443 | 608.1 | 86.8 |

Wherein:
[a]BT = Burn time;
[b]LI = Luminous intensity;
[c]LE = luminous efficiency;
[d]DW = dominant wavelength;
[e]SP = spectral purity.

As can be seen from Table 4, and as stated above, inventive embodiment Formulation H provided almost 13,000 additional candela or luminous intensity—a 67.5% increase in luminosity—with only a reduction in burn time from the current 40.4 to 39.7 seconds versus the current M662 potassium perchlorate based formulation. Further, as stated above, inventive embodiment Formulation G—below) burned 1.39 times brighter, with 1.52 times the luminous efficiency (in [(cd-s)$g^{-1}$]), and had a 3.4 second, or over 8.4% greater/longer burn time than the current M662 potassium perchlorate based red pyrotechnic illuminant formulation. Further still, the dominant wavelength and spectral purities of all tested inventive potassium periodate based red pyrotechnic embodiments were well within the U.S. military specifications for the M662 red pyrotechnic illuminant—i.e. 620+/−20 nanometers and a minimal 76% purity. All of the performance measurement results are not only significant—but, surprisingly so.

Critical to military applications, such as the subject inventive M662 potassium periodate based red pyrotechnic illuminant formulations, is the safety in manufacture, handling, and storage of the particular pyrotechnic material. The subject inventive formulations proved significantly and surprisingly less sensitive to friction ignition than the current M662 potassium perchlorate based material—as stated above, the friction sensitivity of embodiment I of the inventive formulation proved to be greater than 360 Newtons (N) versus only 80 N for the current M662 potassium perchlorate based red pyrotechnic material—an increase of 450%. Further, the inventive formulations also exhibited a high level of thermal stability and were found to be insensitive to electrostatic discharge. Table 5, below, shows a comparison of the current M662 potassium perchlorate based material vs. selected alternative embodiments of the present invention (i.e. alternative embodiment H is omitted—as it has a shorter burn time than the current potassium perchlorate material and hence doesn't meet the standard for burn time for the M662 40 mm red star parachute illuminant).

TABLE 5

Sensitivity of the current and inventive illuminants.

| Formulation | Impact Sensitivity[1] (J) | Friction Sensitivity[2] (N) | Electrostatic Discharge Sensitivity[3] (J) |
|---|---|---|---|
| Current M662 | 6.86 | 80 | >0.25 |
| G | 7.35 | 240 | >0.25 |

TABLE 5-continued

Sensitivity of the current and inventive illuminants.

| Formulation | Impact Sensitivity[1] (J) | Friction Sensitivity[2] (N) | Electrostatic Discharge Sensitivity[3] (J) |
|---|---|---|---|
| I | 7.35 | >360 | >0.25 |
| J | 5.88 | 240 | >0.25 |

Note 1.
NATO Standardization Agreement (STANAG) 4489, Ed. 1 Explosives, Impact Sensitivity Tests. 17 Sep. 1999.
Note 2.
NATO Standardization Agreement (STANAG) 4487, Ed. 1 Explosives, Friction Sensitivity Tests, 22 Aug. 2002.
Note 3.
NATO Standardization Agreement (STANAG) 4490, Ed. 1. Explosives, Electrostatic Discharge Sensitivity Tests, 19 Feb. 2001.

As summarized above, in formulating the present inventive pyrotechnic illuminant compositions, useful as a red M662 40 mm parachute illuminant, an embodiment of the ingredients detailed in Table 2 are mixed under ambient condition. More specifically, a preferred method is to perform the mixing using a Hobart air mixing bowl, Hobart, Troy, N.Y., where the Hobart mixer is equipped with a B-Blade. As further detailed above, preferably the binder is first added to the Hobart mixer and mixed with the magnesium; the potassium periodate is then mixed in; the PVC and strontium nitrate are then mixed in (which two ingredients can be premixed and added together)—all mixing is done until a uniform mixture is obtained (wherein about 10 to about 20 minutes mixing can be required to obtain a uniform mixture). With the use of the preferred Epon 813/Versamid 140 binder system, the final unpacked mixture should be allowed to sit and dry, unconsolidated for about 1 to about 3 hours—whereupon it can be packed into the desired illuminant form and preferably cured in an oven, at about 60 degrees C. overnight, i.e. for a period of about 12 hours. It is important to note that there is a difference between these drying and curing steps;

wherein, drying is just a physical process and curing is chemical (i.e. growth of cross-linked chains). Finally, the consolidation must be done before oven curing, and for example, may involve an 80 g increment, preferably with a dead load of about 10,000 pounds, for a dwell time of at least about 10 seconds.

The particular ingredients useful in the present inventive red pyrotechnic illuminant are all commercially available. Specifically, the strontium nitrate ($Sr(NO_3)_2$) oxidizer, with a preferred volume-based mean particle size of about 23.3 μm, and the polyvinyl chloride (PVC) chlorine donor, with a preferred volume-based mean particle size of about 123.4 μm, are available from Hummel Croton, located in South Plainfield, N.J. The second oxidizer, potassium periodate, with a preferred volume-based mean particle size of about 42.3 μm, is available from Ashland Chemical Company, which has a location in Budd Lake, N.J. The 30 to 50 mesh inorganic fuel/gray body emitter magnesium (Mg 30/50), with a preferred volume-based mean particle size of about 523.44 μm, is available from Magnesium Elektron, located in Manchester, N.J. The Epon 813 component of the binder system (80%) is available from Momentive, located in Columbus, OH. And the Versamid 140 component of the binder system (20%) is available from BASF, located in Cincinnati, Ohio.

We claim:

1. An environmentally friendly red pyrotechnic illuminant composition with improved luminosity and improved safety consisting of:

a. from about 41.1 to about 39.1 weight percent of a first oxidizer, which oxidizer is strontium nitrate;
b. from about 30.8 to about 35.8 weight percent of an inorganic fuel, which inorganic fuel is 30/50 magnesium powder;
c. about 12.8 weigh percent of a chlorine donor, which chlorine donor is polyvinyl chloride;
d. from about 10.3 to about 5.3 of a second oxidizer, which second oxidizer is potassium periodate; and
e. from about 5.0 to about 7.0 of binder system;
f. wherein said red pyrotechnic illuminant composition provides a luminous intensity of at least 26,471 candela and a friction sensitivity which is at least 240 Newtons.

2. The environmentally friendly red pyrotechnic illuminant composition with improved luminosity and improved safety of claim 1, wherein the binder system is comprised of 80 weight percent of a low viscosity liquid bisphenol-A based epoxy resin diluted with cresyl glycidyl ether and 20 weight percent of a medium to low viscosity, reactive polyamide-based resin solution that cures at room temperature.

3. The environmentally friendly red pyrotechnic illuminant composition with improved luminosity and improved safety of claim 1, wherein the dominant wavelength ranges from 607.2 to 608.4 nm and the spectral purity is at least 86.8 percent.

4. The environmentally friendly red pyrotechnic illuminant composition of claim 1 wherein the potassium periodate mean particle size is about 42.3 μm.

* * * * *